United States Patent [19]

Gustafson

[11] 4,056,738

[45] Nov. 1, 1977

[54] THRESHOLD CIRCUIT

[75] Inventor: Kjell Arne Håkan Gustafson, Karlskoga, Sweden

[73] Assignee: AB Bofors, Bofors, Sweden

[21] Appl. No.: 653,324

[22] Filed: Jan. 29, 1976

[51] Int. Cl.[2] ..... H03K 5/20; H03K 5/18

[52] U.S. Cl. ..... 307/359; 307/360; 328/115

[58] Field of Search ..... 307/235 R, 235 E, 235 K, 307/235 N, 232, 233 R; 328/115.7, 150; 235/150.23, 150.26, 150.27; 340/27 R, 27 AT, 27 NA, 15.5 AC

[56] References Cited

U.S. PATENT DOCUMENTS

| | | | |
|---|---|---|---|
| 3,758,868 | 9/1973 | Brown | 307/235 K |
| 3,801,830 | 4/1974 | Boyer | 307/235 E |

*Primary Examiner*—John Zazworsky

*Attorney, Agent, or Firm*—Pollock, Vande Sande & Priddy

[57] ABSTRACT

A threshold circuit for signal receiving equipment, particularly optical signals travelling to or from a rapidly flying object comprises a threshold determining device having an input accepting signal and noise pulses and an output emitting transmitted pulses which correspond to the signal and noise pulses that pass the threshold unit. Control circuits determine the threshold that is employed in response to the received signal and noise pulses. If the received signal and noise pulses have a relatively low amplitude, a relatively low predetermined threshold is employed. If the received noise and/or signal pulses increase in amplitude for a sufficient length of time, the control circuits respond by raising the threshold.

6 Claims, 4 Drawing Figures

THRESHOLD CIRCUIT

The present invention relates to a threshold circuit for signal receiving equipment, and is intended for use particularly for optical signals travelling to or from an airborne object, e.g. in the form of a missile, rocket or similar rapidly flying object. The threshold circuit is type that includes a unit for determining a threshold with an input receiving signal and noise pulses and an output emitting transmitted pulses which correspond to the signal and noise pulses which exceed the threshold.

With so-called optical beam rider guidance of e.g. missiles it has been found that the signal/noise ratio of control signals can vary considerably due to, the change in distance between the transmitter and the receiver, the smoke developed from the source of propulsion of the missile, and solar and atmospheric interference. The missile can also be subjected to jamming by an enemy.

In order to obtain entirely reliable guidance of the missile notwithstanding these causes of modulation and interference, it has been proposed, previously, possibly in combination with increased transmission power, to increase the sensitivity of the receiver of the missile so that with its accuracy maintained, it could operate with a lower signal/noise ratio.

However, such an increase of the sensitivity of the receiver requires more space in the missile, and at the same time the manufacturing costs will increase and the operation becomes more difficult.

The purpose of the present invention is to create a threshold circuit which primarily solves these problems. The feature that can be considered characteristic for the new threshold circuit is the unit which determines the threshold is arranged so that it can be controlled by means of control circuits. The control circuits may achieve a higher threshold by generating a first control magnitude when the parameter actuating the unit from the received pulses exceeds a certain reference level during a predetermined time (e.g. 20 ns) and with a given number of pulses per unit of time. The control circuits may achieve a lower threshold for the unit, chosen in relation to a mean value of the noise pulses, by generating a second control magnitude when the parameter actuating the unit from the received pulses is at or below said reference level.

The new threshold circuit is particularly suitable for use in a detection system which works with a predetermined number of permissible noise pulses per unit of time, the signal pulses then being separated from the noise pulses by sensing the phase position of the different pulses. By utilizing the knowledge that a missile in two consecutive time instants does not deviate greatly from its course. Further developments of the concept of the invention resulted in embodiments which are particularly attractive from economic and technical viewpoints.

Figure 1:
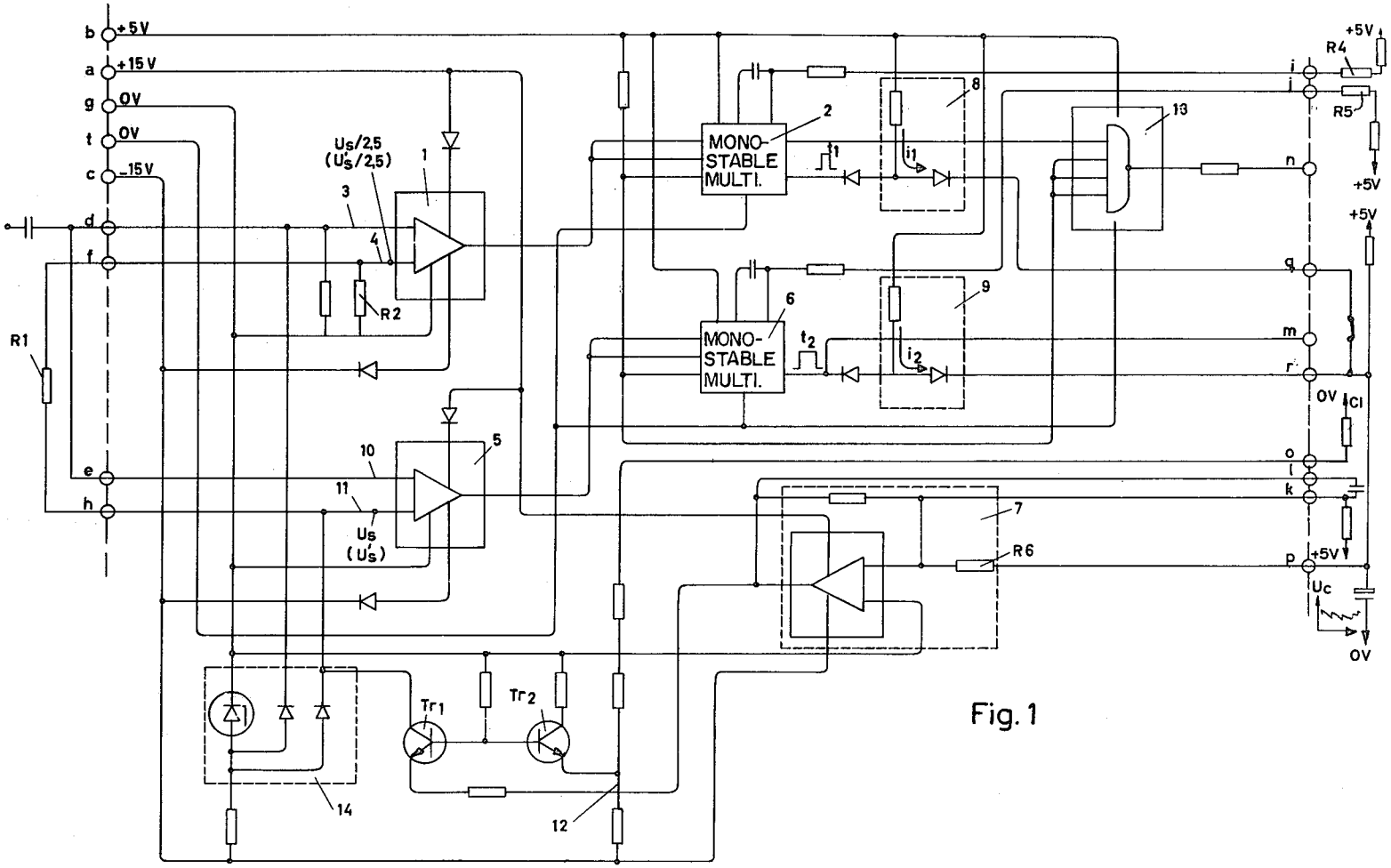
Figure 2:
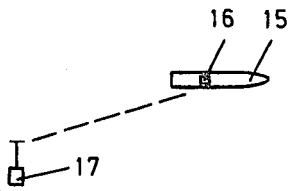
Figure 3A:
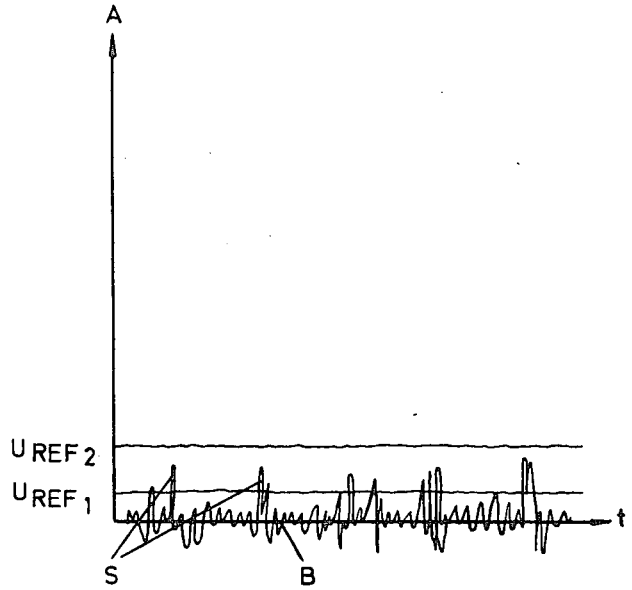
Figure 3B:
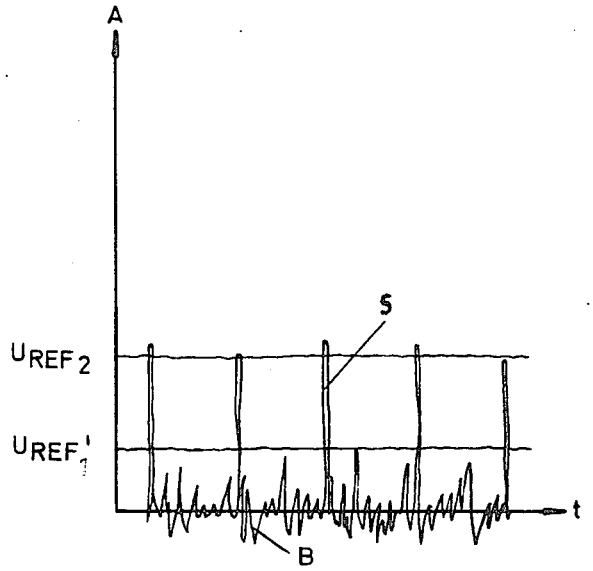

An embodiment proposed at present which has the characteristics significant for the threshold circuit according to the invention will be described in the following, with reference to the accompanying drawings, in which FIG. 1 in the form of a block diagram illustrates the threshold circuit, FIG. 2 shows a sketch of a missile utilizing the threshold circuit according to FIG. 1, and FIGS. 3*a*–3*b* show in a diagram form two cases in principle occurring at the threshold circuit.

The equipment shown in FIG. 1 can be implemented on a printed circuit with the connection points indicated by the letters *a* - *r* and *t*. The threshold circuit has an input *d* and an output *n*. The input receives, signal and interference pulses (noise pulses) which have been preprocessed in filter and amplifier circuits not shown. The received noise pulses occur at random with varying amplitude, while the signal pulses occur with a predetermined phase position and possibly varying amplitude. At the output, pulses are received with a constant amplitude which correspond to the pulses that pass the threshold circuit.

The threshold circuit includes a unit which determines the threshold, in the form of a first comparator 1, and a monostable multivibrator 2 connected to its output. The first comparator has a first input 3 connected to the input *d* of the threshold circuit and a second input 4 connected to a feedback circuit which is included in the control circuits described below. Depending on the output from the comparator, the first monostable multivibrator emits transmitted pulses with a first duration $t_1$, which in this case has been chosen at 500 ns. These produce output pulses, after buffering at AND gate 13.

The first comparator is provided with control circuits which depending on the amplitude of the received signals generate a first control magnitude or a second control magnitude so that a higher threshold or a lower threshold, respectively, can be obtained in the first comparator. The generating of said control magnitudes takes place by means of a reference level utilized in the control circuits.

Said control circuits include a second comparator 5 and with a second monostable multivibrator 6 connected to its output. Depending on the pulses on the output of the second comparator 5 the multivibrator emits transmitted pulses with a duration $t_2$ which greatly exceeds the duration $t_1$ and is approx. 25 μs. The control circuits also include a feedback circuit which extends from the outputs of the first and second monostable multivibrators and includes an integrator in the form of an integrating capacitor C, a multiplier 7 and a differential amplifier comprising transistors $Tr_1$ and $Tr_2$. The integrator is connected to the outputs of the monostable multivibrators via voltage-to-current converting devices 8 and 9 (see $i_1$ and $i_2$ respectively) which consist of a resistor and a diode. The first input 10 of the second comparator is connected to the input *d* of the threshold circuit, while the output of the differential amplifier is connected to the second input 11 of the second comparator as well as to the second input of the first comparator 1 via a resistor $R_1$ which forms a voltage divider with a resistor $R_2$.

As shown in FIG. 1, inputs 3 and 11 of comparators 1 and 5 are clamped, through diodes, to a potential determined by a zener diode in circuit 14.

The threshold circuit illustrated is intended for use in a detection system which is able to accept a predetermined number of noise pulses per unit of time. The illustrated threshold circuit includes a resistor $R_3$ to set the number of noise pulses. The threshold circuit also includes trimming resistors $R_4$ and $R_5$, for determining the first time $t_1$ (approx. 500 ns) and the second time $t_2$ (approx. 25 μs). The reference voltage on the first comparator is equal to the reference voltage of the second comparator divided by 2.5.

The circuit functions as follows. When only pulses below a reference level determined by the second comparator appears at the input, the first comparator will have the lower predetermined threshold. The received pulses will then pass this lower threshold and produce output pulses on the output of the first monostable multivibrator, which output pulses, in accordance with what is stated above, have a constant amplitude and a constant pulse width time $t_1$. The resulting pulses provided by the device 8 having a corresponding charge content are fed to the integrator C, over which a saw-toothed voltage $u_c$ is obtained. This voltage is fed to the multiplier 7, which multiplies the saw-toothed voltage by a factor of $-2.5$. The multiplied voltage is filtered in a filtering capacitor $C_1$. The voltage on the output of the multiplier determines the current through the transistor $Tr_1$ in the differential amplifier and therefore the reference voltage on the reference inputs 4 and 11 of the first and the second comparators, respectively. The resistor $R_1$ in the voltage divider $R_1/R_2$ has been chosen so that the first comparator will have a lower reference voltage than the second comparator. This results in the second comparator having a threshold which is higher than the threshold of the first comparator which, in turn, means that the pulses occurring on the input *d* with the assumed level do not pass the second comparator 5. The reference voltage at point 12 of the differential amplifier is determined by the trimming resistor $R_3$, i.e. the output voltage from the differential amplifier and therefore the control voltages for the comparators are determined by this trimming resistor. By raising and lowering the threshold with the resistor $R_3$, the number of noise pulses per unit of time for which the circuit is to work can be selected. In the present example of the embodiment, the circuits are arranged to work with automatic setting for 10,000 pulses/s. When the number of pulses per unit of time tends to increase above the number of noise pulses that has thus been set, the lower threshold will automatically be raised, so that only the number of pulses for which the device has been set will pass, and vice versa. For example, if the received number noise pulses per unit time increases, the frequency of multivibrator 2 increases since the multivibrator 2 produces an output for every received pulse exceeding the threshold. This increases the charge on capacitor C and also the output of the multiplier 7. This increases the bias on T11 and raises the threshold to thereby limit the number of noise pulses which pass comparator 1. During the same unit of time (1 *s*) approx. 500 signal pulses can be expected to occur, and thus 9500 noise pulses per s can pass the threshold. If the noise consists of normally distributed noise with a certain band width, this means that the threshold will be on a level fixed in relation to the rms value of the noise. On the other hand, if pulses with a level exceeding the reference level or the threshold in the second comparator occur on the input *d*, these pulses will not only pass the first comparator, but also the second comparator, and therefore pulses with a longer duration of $t_2$ (25 $\mu$s) will be obtained on the output of the second monostable multivibrator. As corresponding pulses with a comparatively large charge content are produced by the device 9, the voltage $u_c$ will increase with a change jumping to a value exceeding the previous value. If pulses with a higher amplitude occur on the input during a minimum predetermined time, e.g. 20 ns, and there is a sufficient number of these per unit of time, these pulses will dominate the charging of the capacitor C. With the increased voltage $u_c$, the control magnitudes on the inputs of the first and the second comparators will be increased, which raises the threshold in the two comparators. The higher threshold thus obtained in the first comparator means that only pulses with the higher amplitudes can pass the comparator to the associated monostable multivibrator. On the other hand, the threshold in the second comparator 5 is not raised more than that the second comparator 5 can continue to let through pulses with the higher amplitudes.

In the case when pulses with greater amplitude determine the output control voltage $\Delta u_s$ from the transistor $Tr_1$, a first control magnitude of $\Delta u_s/2.5$ which gives the first comparator 1 its higher threshold will be obtained on the input 4 of the first comparator. In the corresponding way, a second control magnitude $\Delta u_s'/2.5$ which determines the lower threshold in the first comparator 1 will be obtained when only pulses with a lower amplitude are received on the input. From the description given above, it will be obvious that the magnitude of the two first and second control magnitudes $\Delta u_s/2.5$ and $\Delta u_s'/2.5$ can vary so that the respective threshold of said higher and lower thresholds in the comparator 1 can vary within a certain threshold range. In certain situations, the threshold ranges for the respective control magnitudes can even border on or overlap each other.

Considering the strictly practical case of the optical beam rider guidance, tests have shown that in most firing cases the amplitude of the received signal pulses drive the first comparator up to its higher threshold, which means that the guidance will be comparatively interferences or noise insensitive to external. In some cases, however, the modulation and noise phenomenon, as well as poor visibility and transmission conditions, will reduce the amplitudes of the received signals in this case, guidance on the basis of the signal level will not be suitable. Through the change to a lower threshold, previously described, which is appropriately chosen in relation to the so-called rms value of the noise, in these comparatively few firing cases, the noise level can be allowed to control the threshold. It is then conceivable that noise received with an amplitude which is higher than the amplitude of the second comparator will pass the second comparator and cause charging of the capacitor C. However, such interference must occur with a minumum number per unit of time, in order to achieve a setting up to the higher threshold and therewith a loss of signal pulses. Through the requirement of a maximum of 10,000 noise pulses per s it is also conceivable if there is strong interference and a low signal/noise value that signal pulses will be lost. The invention then utilizes the knowledge that said case seldom occurs, and that the missile usually does not suddenly change its course. Thus signal transmission is a small part of the trajectory and should not have any significance.

FIG. 3*a* is intended to illustrate the case when the amplitude of the pulses S received are below the reference level $^{U}REF_2$ formed by the second comparator.

In accordance with the above, the unit which determines the threshold assumes its lower threshold, which is indicated by $^{U}REF_1$ and which automatically is set so that 9500 noise pulses B/*s* can pass this lower threshold. The reference level is set at a value which is equal to 2.5 $\times$ $^{U}REF_1$. FIG. 3*b* shows the case where the amplitude of the pulses received is great in relation to the reference level $^{U}REF_2$ which by the first control magnitude has also been given a higher value in comparison with the case according to FIG. 3*a*. The reference level $^{U}REF_2$ then assumes a value which essentially corresponds to the amplitude of the pulses. In this case, the higher threshold $^{U}REF_1$ is obtained in the unit which determines the threshold, which higher threshold assumes a value which will be $^{U}REF_2/2.5$.

In one embodiment the integrating capacitor is 15 μF, while the associated discharging resistor $R_6$ is 22 kΩ, which gives the discharging time constant of 330 ms. The time constants in the charging circuits with a resistance 9 of 510 Ω and a resistance 8 of 390 Ω will be ≈ 7.7 ms and ≈ 5.9 ms, respectively. This means that approx. 200–300 pulses are to pass the reference level formed by the second comparator 5 according to FIG. 3*a* during a prescribed time if the first comparator is to be raised from the lower threshold (threshold range) to the higher threshold (threshold range).

In the illustrated embodiment, commercially available comparators with the designation LM106 have been chosen. Of the components which have not been described in detail there is a driving circuit 13. The circuit also includes protective diodes, shown within the dash line frame 14. The other components consist of connection elements, the function of which should be obvious from the context. Although FIG. 1 illustrates $Tr_1$ and $Tr_2$ as *n-p-n* transistors, it should be apparent that *p-n-p* transistors could be used as well with appropriate modifications of the circuit.

In FIG. 2, the receiving equipment in a missile 15 is shown by the numeral 16, while transmitter equipment on the ground is designated 17.

The invention is not limited to the embodiment shown as an example in the foregoing, but can be subject to modifications within the scope of the following claims.

I claim:

1. A threshold circuit for signal receiving equipment particularly suited for use in signalling to or from a rapidly flying object such as a missile or rocket having means for establishing a threshold with an input for receiving signal pulses and noise pulses and an output for emitting pulses corresponding to those pulses at said input which pass the threshold circuit, wherein the improvement comprises:

first and second control means, responsive to said input pulses and noise pulses for generating a first or second threshold within first or second predetermined threshold ranges, said first control means producing a first threshold in response to a condition when said input signal pulses and noise pulses exceed a predetermined reference level for a predetermined period of time with a predetermined number of pulses per unit time, for limiting the number of noise pulses per unit time passing to said output, said second control means producing a second threshold in the absence of said condition, wherein said second threshold is lower than said first threshold.

2. A threshold circuit according to claim 1 wherein said first and second control means comprises:

a first comparator having an output coupled to a first monostable multivibrator, one input of said first comparator connected to said input of said threshold circuit, a second comparator input provided with a signal related to said threshold, said first monostable multivibrator producing pulses in response to said first comparator output of a first duration.

3. The threshold circuit of claim 2 wherein said first and second control means comprises:

a second comparator having an output coupled to a second monostable multivibrator, said second comparator having an input connected to said input of the threshold circuit and a second input provided with a signal related to said threshold, said second monostable multivibrator emitting pulses in response to an output of said second comparator having a second duration exceeding said first duration.

4. The threshold circuit of claim 3 in which a feedback circuit provides said second inputs to both said comparators, said feedback circuit comprises:

an integrator connected to outputs of said first and second monostable multivibrators via voltage-current converting means, a multiplier connected to the output of said integrator, and a differential amplifier including a pair of transistors coupled to an output of said multiplier and providing said second inputs to first and second comparators, said first threshold generated in response to output pulses from said second monostable multivibrator and said second threshold generated in response to pulses from said first monostable multivibrator.

5. The threshold circuit of claim 4 in which said pair of transistors is connected directly to said second input of said second comparator and connected, via a voltage divider, to the second input of said first comparator.

6. The threshold circuit of claim 4 in which said pair of transistors compares said multiplier output with a potential generated via a trimming resistor coupled to said transistors, said trimming resistor determining the number of noise pulses passing said threshold circuit.

* * * * *

UNITED STATES PATENT AND TRADEMARK OFFICE

CERTIFICATE OF CORRECTION

PATENT NO. : 4,056,738

DATED : November 1, 1977

INVENTOR(S) : Gustafson

It is certified that error appears in the above-identified patent and that said Letters Patent are hereby corrected as shown below:

Please insert on the heading page, after the filing date -- Priority date February 10, 1975, Swedish No. 75.01418

Signed and Sealed this

*Fourteenth* Day of *February 1978*

[SEAL]

*Attest:*

RUTH C. MASON
*Attesting Officer*

LUTRELLE F. PARKER
*Acting Commissioner of Patents and Trademarks*